US009636697B1

(12) United States Patent
Jih

(10) Patent No.: US 9,636,697 B1
(45) Date of Patent: May 2, 2017

(54) ELECTRONIC CANDLE FOUNTAIN

(71) Applicant: Nature's Mark, LLC, Houston, TX (US)

(72) Inventor: Tsai Ming Jih, Xiamen (CN)

(73) Assignee: Nature's Mark, LLC, Houston, TX (US)

( * ) Notice: Subject to any disclaimer, the term of this patent is extended or adjusted under 35 U.S.C. 154(b) by 0 days.

(21) Appl. No.: 14/938,376

(22) Filed: Nov. 11, 2015

(51) Int. Cl.

| | |
|---|---|
| ***B05B 17/08*** | (2006.01) |
| ***F21V 31/00*** | (2006.01) |
| ***F21V 23/04*** | (2006.01) |
| ***F21S 6/00*** | (2006.01) |
| *F21W 121/02* | (2006.01) |
| *F21Y 101/02* | (2006.01) |

(52) U.S. Cl.
CPC ..... *B05B 17/08* (2013.01); *F21S 6/001* (2013.01); *F21V 23/0435* (2013.01); *F21V 31/005* (2013.01); *F21W 2121/02* (2013.01); *F21Y 2101/02* (2013.01)

(58) Field of Classification Search
CPC ..... F21W 2121/02; B05B 17/08; F21V 23/04; F21V 23/0435; F21V 31/005; F21S 6/001
USPC ..... 239/17, 20, 22, 23
See application file for complete search history.

(56) References Cited

U.S. PATENT DOCUMENTS

| | | | |
|---|---|---|---|
| 6,439,471 | B2 | 8/2002 | Ehrlich et al. |
| 6,443,364 | B1 | 9/2002 | Lin |
| 9,080,762 | B2 | 7/2015 | Ray |
| 2001/0036609 | A1 | 11/2001 | Ehrlich et al. |

*Primary Examiner* — Christopher Kim
(74) *Attorney, Agent, or Firm* — Whitaker Chalk Swindle & Schwartz PLLC; Charles Gunter

(57) ABSTRACT

A decorative display apparatus comprising a flameless candle with an integrated fountain is disclosed. The flameless candle with integrated fountain is designed to be a stand-alone device. The flameless candle with integrated fountain includes a translucent candle body containing a water reservoir, a power source, a pump and a water diversion board. The pump is used to pump water from the reservoir out an opening in the top of the water diversion board so that the water flows over the top of the board and back into the water reservoir to be recycled. An LED light source located below the diversion board has light emitting elements which illuminate the candle interior and provide a decorative lighting effect. The flameless candle with integrated fountain also features a remote control unit for operating the various operating modes of the device.

8 Claims, 5 Drawing Sheets

ELECTRONIC CANDLE FOUNTAIN

BACKGROUND OF THE INVENTION

1. Field of the Invention

The present invention relates to an electronic lighting fixture, and more particularly to a kind of flameless candle having an integrated fountain aspect which is also provided with a remote control.

2. Description of the Prior Art

A variety of fountain designs have been used by mankind since antiquity. Most people enjoy fountains, finding the appearance and sound of flowing water soothing. In addition to typical outdoor fountains, fountains have been designed with a size and function appropriate for personal use in an interior home or office environment. The sound of naturally flowing water provides a desirable backdrop for sleep, relaxation, and concentration. Some studies have found that natural water sounds increase concentration, acting as "white noise" which minimizes distractions and allows increased focus. Additionally, flowing water fountains act as natural humidifiers by moisturizing the air.

Candles are similarly aesthetically pleasing, as they create a soothing glow. Presently, the majority of fountains and candles which are intended for personal use exist as separate objects. However, it would be desirable to provide a personal fountain which includes the aesthetic properties offered by candles.

The present invention has as an object to provide an electronic candle fountain which combines the pleasing aspects of fountains and candles, and which presents a kind of soft decoration for the home, hotel, church, or other convenient location.

The following are some examples of other typical prior art devices of the general type under discussion which will help to make clear the improvements brought about by the decorative lighting product of the invention. These prior art patents are merely intended to be representative of the general state of the art:

U.S. Pat. No. 6,443,364, issued Sep. 3, 2002, to Lin, entitled "Candle Stand In Combination with a Fountain" shows a combination including a hollow base, a candle stand assembly, and a fountain assembly. A pump is disposed inside the base. The candle stand assembly is mounted on top of the base. The fountain includes a hollow connector and a tube communicating the connector to the pump. A bottom semi-sphere is disposed around the connector and on top of the cover plate. A top semi-sphere is disposed around the connector and above the cover plate. An upper plate and a lower plate are disposed around the connector and between the bottom semi-sphere and the top semi-sphere.

U.S. Pat. No. 9,080,762, issued Jul. 14, 2015, to Ray, entitled "Flameless Candle with Integrated Fountain", shows a flameless candle and integrated candle designed to be used as a stand-alone device. The flameless candle with integrated fountain includes a translucent candle body containing a water reservoir to which an optional scent may be added, a power source which may be a battery, USB or DC supply from an AC converter, a pump and an integrated water and light diffuser. The flameless candle with integrated fountain may be operated in either candle-only mode or candle and fountain mode. The device may also be operated on a timer.

While the above patent references are intended to be representative of the general state of the art, there continues to be room for improvement of devices of this general type in providing a combination flameless candle and integrated fountain which operates as a stand-alone device with practicability and safety and which further is aesthetically pleasing, as well as decorative.

SUMMARY OF THE INVENTION

The electronic remote control candle fountain of the invention can create a kind of quiet and peaceful atmosphere by controlling the color of an associated light-emitting device and also the flash rhythm of the light produced.

The present invention is a decorative display device in the form of a flameless candle having an integrated fountain. In a preferred embodiment, the flameless candle with integral fountain of the invention provides a decorative display apparatus combining the appearance of a traditional wax candle with the sound and appearance of a fountain in a self-contained, portable unit. The decorative display apparatus has an outer cylindrical body, an upper, water-tight, water reservoir chamber containing a water pump, a light source and a water diversion board. The outer cylindrical body also has a lower compartment holding both a power source, a power source on-off switch and remote control electronics. The underwater pump which is located in the water reservoir is used to create a water fountain effect. Thus, in a preferred embodiment, the candle body acts as a water reservoir and also contains a non-flammable light source to provide the candle effect. The light source for the device is preferably an LEI) light source.

In a yet more preferred embodiment, the flameless candle with integral fountain is battery operated.

In a still more preferred embodiment, the flameless candle with integral fountain is provided with an optional remote control unit to turn it on or off and to provide various esthetic visual effects.

Additional objects, features and advantages will be apparent in the written description which follows.

DETAILED DESCRIPTION OF THE INVENTION

In order to further describe the purpose of the present invention, the technical solution and advantages more clearly, the disclosure incorporates the accompanying drawings as well as the detailed description which follows. It should be understood, however, that the preferred embodiments described herein are merely for the better understanding of the present invention and the technical solution, and should not be used to limit the present invention.

As has been mentioned, the purpose of the present invention is to provide a simulated natural candle with an integrated fountain aspect which improves the environment about the device by creating a pleasing and esthetic atmosphere for the owner, which atmospheric effect can be varied to some extent by use of an electronic remote control.

For this purpose, present invention proposes a kind of electronic remote control candle fountain, which includes: a transparent or translucent outer cylindrical body which imitates a traditional, real candle; a transparent or translucent water reservoir; a water diversion board; an LED light source; and a water pump. Preferably, the outer cylindrical body is a hollow tube with a top rim which is decoratively shaped, to some observers, butterfly shaped. As viewed from above, the shape is also somewhat like some types of spring-washers. When viewed from the side, the top rim of the cylinder has a type of undulating shape which is tapered inwardly from an outer top periphery of the cylinder. In one embodiment, the water reservoir is a cup shaped body, which is built into the outer cylindrical body and forming an internal sidewall of the main cylindrical body, with the rim of the cup facing upwards. The LED light source and water pump are also integrated with or built into the water reservoir which houses both the LED light source and LED-PCB. The water pump has an outlet which is connected to a drain pipe.

In one preferred version of the invention, the water diversion board has a diversion hole and the drain pipe is connected directly or indirectly to the diversion hole. When the device is assembled, the water diversion board is located within the interior of the cylindrical body with the periphery of the board being lower than the top rim of the cylindrical body. Some space exists between the outer periphery of the diversion board and the interior sidewalls of the cylindrical body.

The thus described electronic remote control candle fountain of the invention can control the light-emitting device color, the flash rhythm, and create a kind of quiet, peaceful and cozy atmosphere by adjusting the light color according to the surrounding environment and situation, which is conducive to a relaxed mood as well as physical and mental pleasure.

One Example Embodiment

Figure 1A:
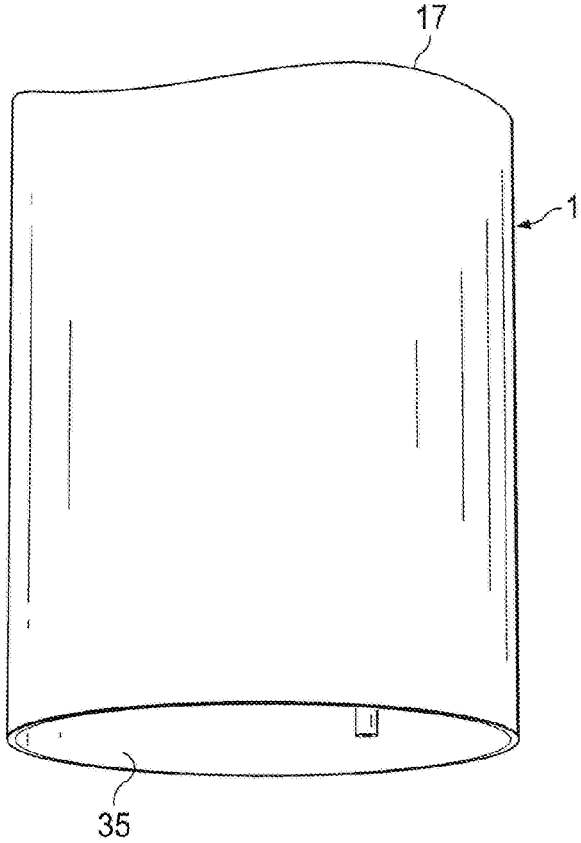
FIG. 1A is a side, perspective view of the electronic candle fountain of the invention.
Figure 1B:
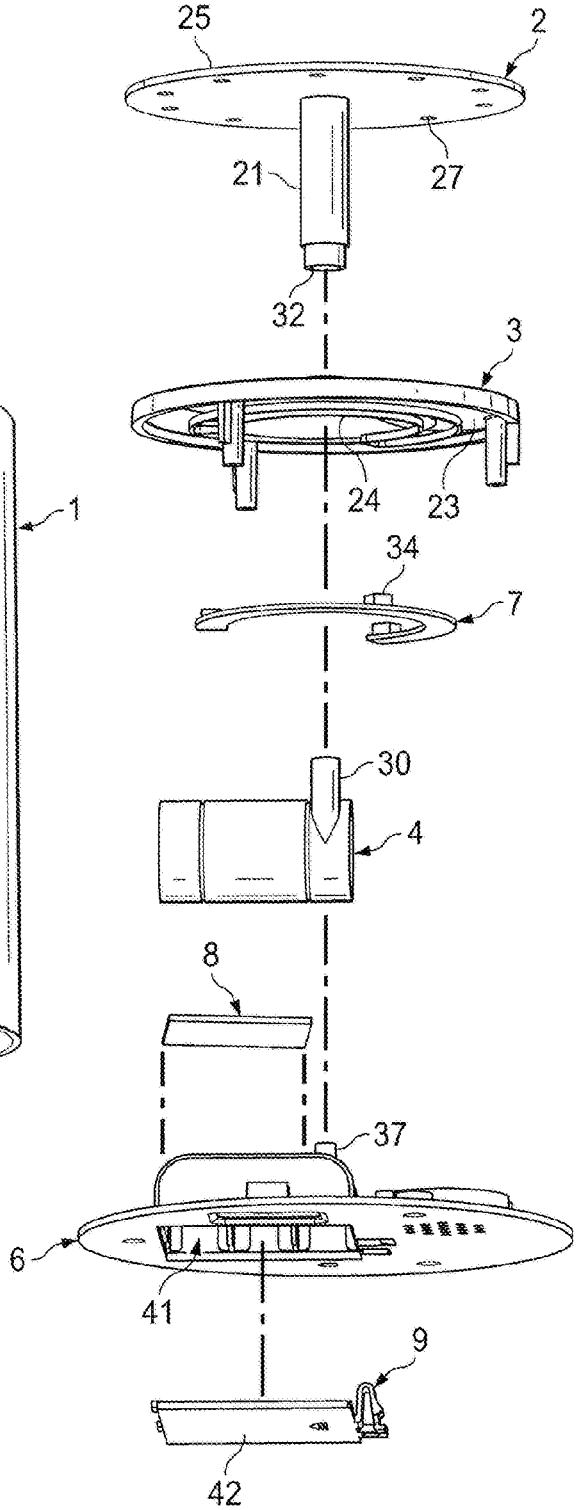
FIG. 1B is an exploded view of the operative components of the candle fountain of FIG. 1A.
Figure 2:
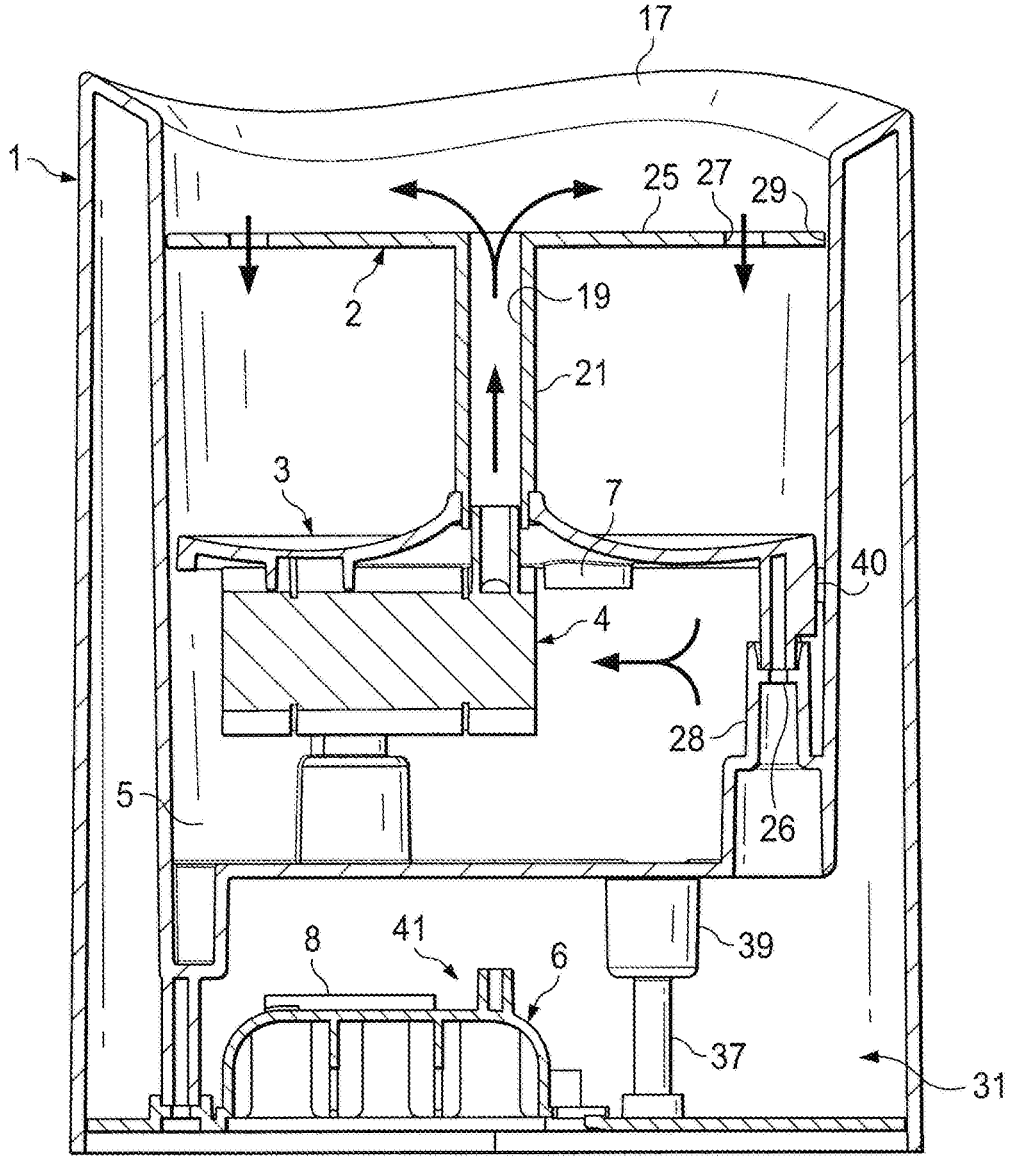
FIG. 2 is a side, partial cross sectional view of the electronic candle fountain of FIG. 1 showing the internal components thereof.

As described in FIGS. 1A, 1B and 2, the electronic remote control candle of the invention comprises: a main body 1 which is preferably a hollow cylinder with the butterfly shaped top rim 17. As briefly described, the top rim forms an undulating pattern, as viewed from the side, and is beveled inwardly and downwardly from the outer periphery of the rim at a gentle angle. The cylindrical body 1 can be formed of any convenient natural or synthetic material, but is preferably made from a plastic, such as a commercially available ABS material, which simulates the traditional concept of the candle texture and feel.

A fluid pump 4 is mounted in a support frame 3 (best seen in FIG. 1B). As seen in FIGS. 1B and 2, the support frame 3 is a generally circular member having a central opening 24 for receiving a connecting tube 21 of the water diversion board 2. The support frame 3 has four equally spaced vertical support legs (e.g., leg 26) which are engaged in mating receptacles 28 provided in the bottom region of the water reservoir 5. The fluid pump 4 is used to pump water from water reservoir (5 in FIG. 2) out of the central hole 19 of the water diversion board 2 by flowing through the connecting tube 21, so as to form a fountain effect. The fluid pump 4 has an outlet port (30 in FIG. 1B) which engages an inlet port 32 of the connecting tube 21 of the water diversion board 2.

Thus, the diversion board functions to divert the water flowing out the central hole 19 and out and over the top surface 25 of the board 2 to form the fountain effect. The water diversion board 2 may also serve to make the light source more diffuse and less harsh than it would otherwise be. The water flows over the board, and downwardly through the apertures (such as aperture 27 in the top surface of the board into the water reservoir 5. Water also flows around the gap (generally at 29 in FIG. 2) between the board and the internal sidewalls of the main body 1, thereby recycling the water.

As shown in FIG. 2, the diversion board 2 must be lower than the lowest point of the top rim 17 of the main body 1, so as to prevent the water from spilling out of the main body candle.

An LED PCB (LED printed circuit board) 7 is mounted to the support frame 3. The LED PCB 7 is semi-circular shaped and has three LED display elements (e.g., element 34 in FIG. 1B). The LED PCB assembly is waterproof sealed with transparent epoxy resin. The support frame 3 thus performs the several functions of fixing the pump 4, the water diversion board 2 and the LED PCB 7 parts within the main cylindrical body. The juncture gap (40 in FIG. 2) is sealed by AB glue, so as to prevent water from flowing out of the water reservoir 5 and into the lower compartment 31.

Another PCB 8 (see FIG. 1B) is mounted below the water reservoir 5 in a lower compartment 31 which is waterproof sealed from the water reservoir by transparent epoxy resin. The lower compartment 31 also houses the battery compartment 41 and an on-off switch (generally at 42 in FIG. 1B.

With reference to FIG. 1B, it can be seen that a base plate 6 is mounted in a circular opening 35 in the bottom region of the cylindrical main body 1. The mating male and female shafts (37 in FIG. 1B and 39 in FIG. 2) help to stabilize the assembly. Looking downwardly from the direction of the rim 17 of the main body, the PCB board 8 is mounted to the base 6, which is located in the waterproof lower compartment 31. A spring biased cover plate 9 is used to cover the battery compartment 41 once batteries are installed.

Figure 3:
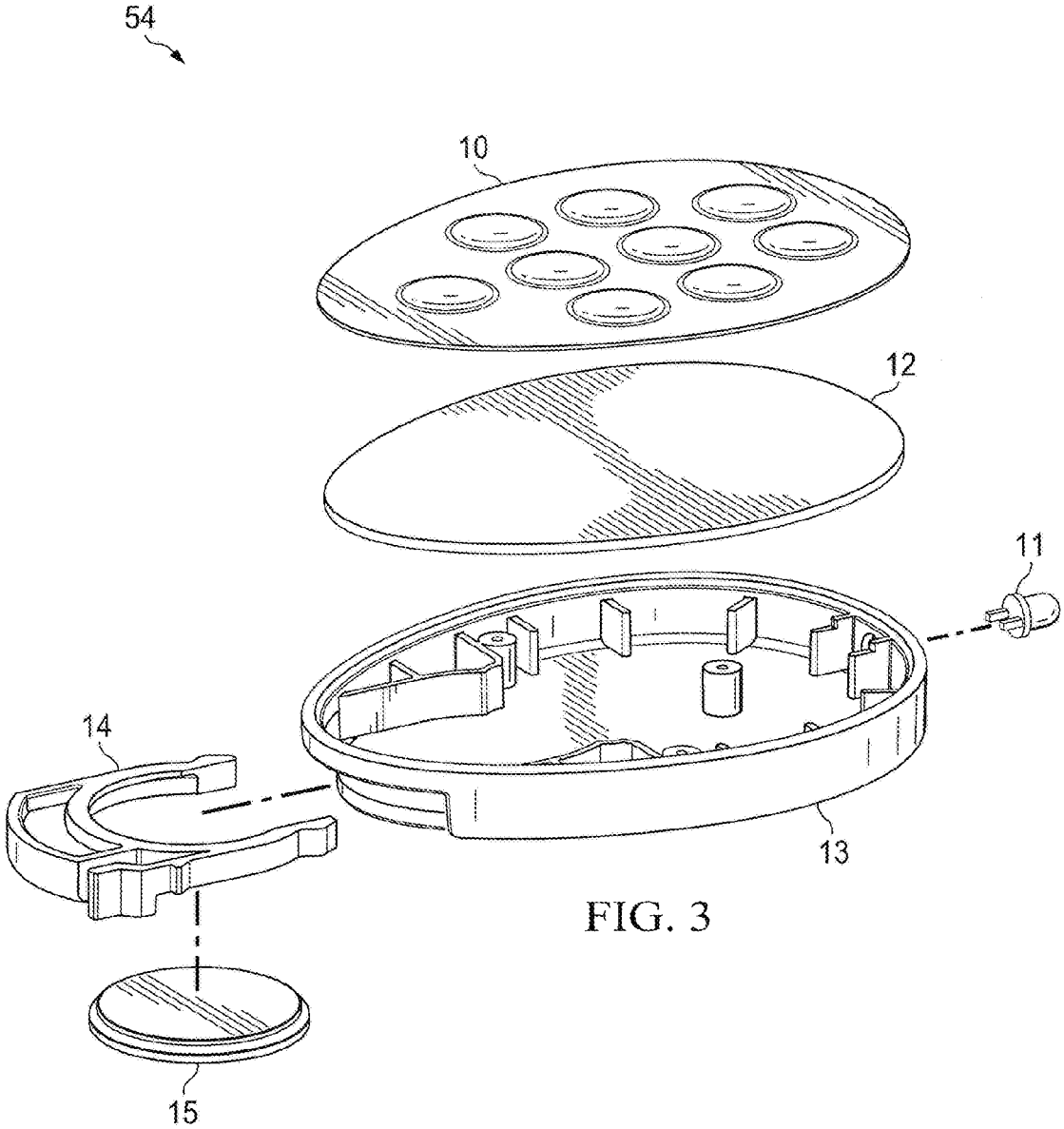
FIG. 3 is an exploded view of the remote control device used with the electronic candle fountain of FIG. 1.

FIG. 3 shows the physical components of the remote control unit (designated generally as 54 in FIG. 3) which is used with the candle fountain of the invention in exploded fashion. The principal component parts include an oval shaped main housing (13 in FIG. 3), containing an LED 11, a cover 10 containing a plurality of push buttons for inputting various commands to the unit, and a PCB 12. A battery holder 14 houses the battery 15.

Figure 4:
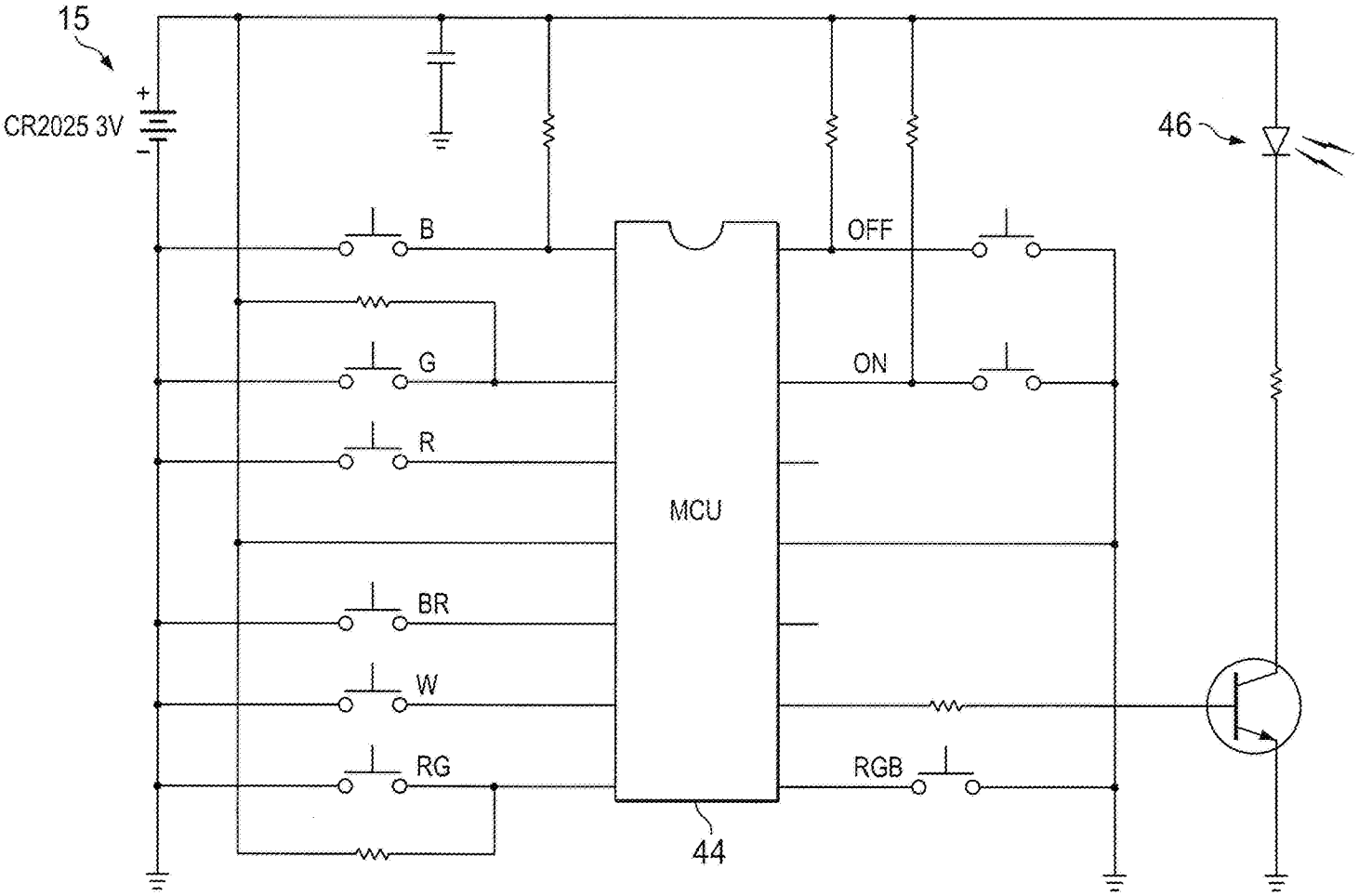
FIG. 4 is an electronic circuit diagram of one embodiment of the remote control of the present invention.
Figure 5:
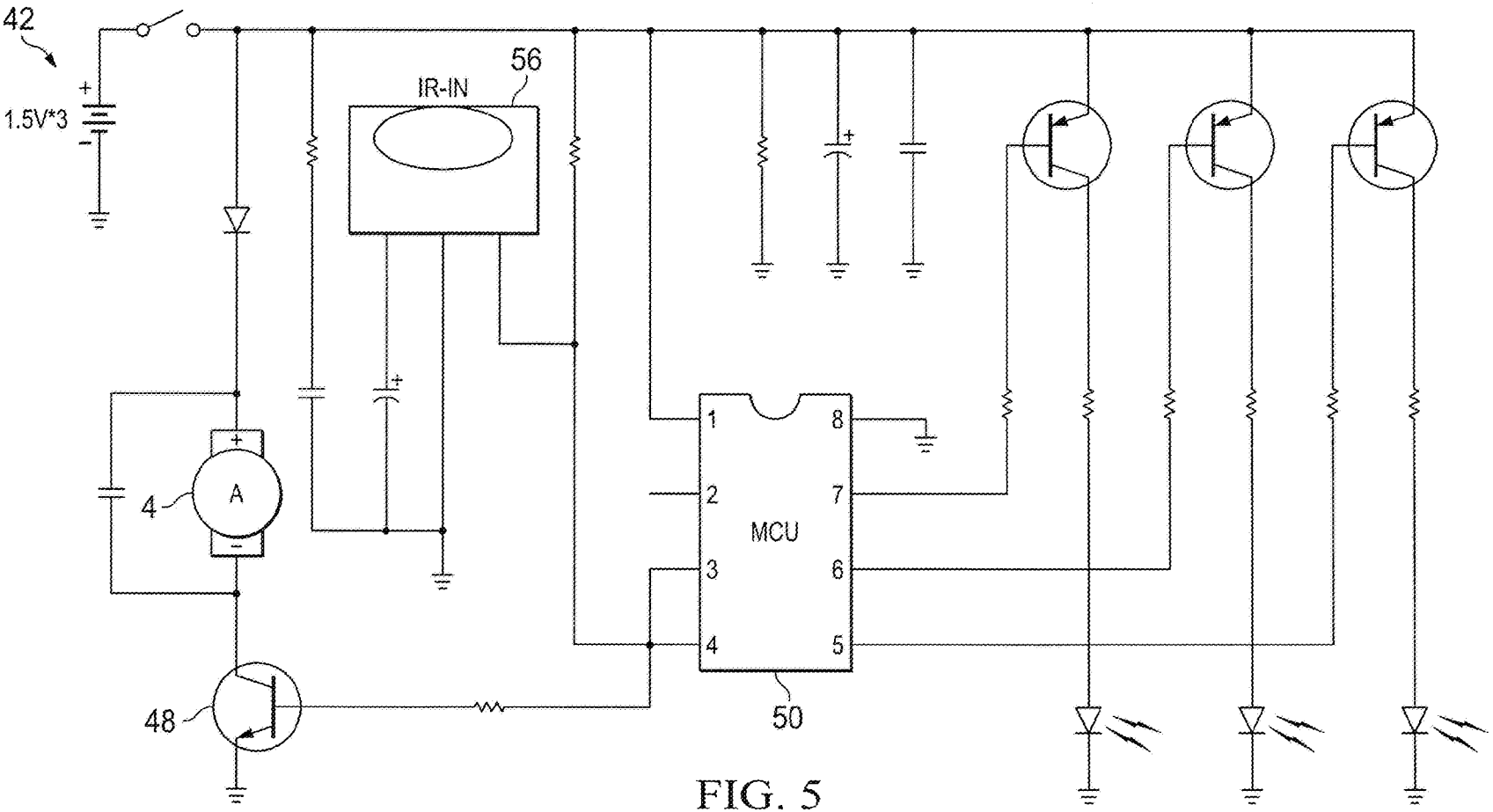
FIG. 5 is an electronic circuit diagram of one embodiment of the main working components of the electronic candle fountain of the present invention.

Referring Now to FIGS. 3-5 for a Brief Description of the Circuit Part of the Control Board, which Comprises:

1. Power supply: a CR2025 (15 in FIG. 3) high-energy lithium manganese battery directly supplies the control circuit of the remote control part (FIG. 3). The power of the host part circuit board is supplied by 3 LR6 alkaline batteries located in the battery compartment 41 in FIG. 1B, which is controlled by a 2-way slide switch 42.

2. Remote control part: as shown in FIG. 4, a microprocessor control unit, MCU, (44 in FIG. 4) uses 32 bits serial code modulated by pulse width, and after secondary modulation by a 38 kz carrier frequency, emits infrared which is produced by an infrared emission diode 46. Different buttons on the remote control part (FIG. 3) are provided to operate the switches labeled B, G, R, BR, W, and RG (FIG. 4) to control the output drive signals corresponding to the different modulation codes programmed into the MCU 50 for the different colors emitted by the three LEDs shown in FIG. 5. The three LEDs are driven by three respective driver transistors in response to the modulation codes in the MCU 50, which outputs the output drive signals at the ports 5, 6, and 7.

3. Host part: as shown in FIG. 5, when the slide switch 42 is turned to the "on" position, the 3rd port of the MCU 50 outputs a high level of 3.3V, which is used to drive the pump 4 by means of a driver transistor 48. In the meantime, the $5^{th}$, the $6^{th}$ & the $7^{th}$ ports output the low level output drive signals to the three driver transistors to drive the red, green and blue—3 colored 5050 SMD chip LED's to work in a fixed mode, wherein the fixed mode provides the 7-colored cycle changes. At the time the slide switch is turned on, the circuit board is in a stand-by mode. When a selected button is pressed, the serial code emitted transfers to the $4^{th}$ port of the MCU 50 after the decoded high/low-level output by the infrared receiver 56 ("IR-IN" on FIG. 5). After receiving the different high/low-level, the output of the MCU 50 the $5^{th}$, the $6^{th}$ & the $7^{th}$ ports have the corresponding changes, so as to achieve a different lighting effect.

An invention has been provided with several advantages. The present invention provides an electronic candle fountain which combines the pleasing aspects of fountains and candles, and which presents a kind of soft background decoration for the home, hotel, church, or other convenient location. The electronic remote control candle fountain of the invention can create a kind of quiet and peaceful atmosphere by controlling the color of an associated light-emitting device and also the flash rhythm of the light produced. The flameless candle with integral fountain of the invention is also provided with an optional remote control to turn it on or off and to provide various esthetic visual effects.

While the invention has been shown in one of its forms, it is not thus limited but is susceptible to various changes and modifications without departing from the spirit thereof.

What is claimed is:

1. A decorative display apparatus comprising:

an outer cylindrical body containing a water reservoir chamber in an upper region thereof;

a support frame located within the interior of the cylindrical body in a mid-region of the water reservoir chamber, the support frame having a circular periphery which is received within the interior of the outer cylindrical body, the support frame also having a central opening therein;

a water diversion board having a lower surface and a planar upper surface with a central water dispensing opening and a plurality of holes communicating the planar upper surface with the water reservoir located below, and wherein the water diversion board has a connecting tube which passes through central opening in the support frame;

a water proof pump located in the water reservoir chamber and immersed in water in the chamber in use, the water proof pump being carried on a lower surface of the support frame, and wherein the water proof pump has an outlet port which is in fluid communication with an inlet port of the water diversion board connecting tube, whereby water can be pumped through the connecting tube and out the central water dispensing opening of the water diversion board and over the upper planar surface thereof;

a light source located in the water reservoir above the pump, the light source being also water proofed, the light source having a plurality of light elements which emit light upwardly in the direction of the lower surface of the water diversion board in use;

a lower compartment located in the outer cylindrical body below the water reservoir, the lower compartment being water proof sealed from the water reservoir and containing a power source, an on-off switch and a printed circuit board containing main control electronics for controlling various light effects achievable by the light source.

2. The decorative display apparatus of claim 1, wherein the outer cylindrical body comprises a translucent material.

3. The decorative display apparatus of claim 2, wherein the power source comprises at least one battery.

4. The decorative display apparatus of claim 3, wherein the light source comprises a plurality of light emitting diodes (LEDs).

5. The decorative display apparatus of claim 4, wherein the on-off switch is constructed and arranged to selectively control power to the pump and light source.

6. The decorative display apparatus of claim 1, wherein the main cylindrical body also houses remote control electronics which are controlled by a remote control unit for controlling the various light effects achievable by the lighting device.

7. The decorative display apparatus of claim 6, wherein the remote control contains a microprocessor control unit with associated circuitry which emits infrared signals from an infrared emission diode with different buttons being provided on the remote control unit which emit different modulation codes to control various lighting effects of the light source.

8. A decorative display apparatus in the form of a flameless candle with integral fountain which combines the appearance of a wax candle with a sound and appearance of a fountain in a self-contained, portable unit, the decorative display apparatus comprising:

an outer cylindrical body containing a water reservoir chamber in an upper region thereof;

a support frame located within the interior of the outer cylindrical body in a mid-region of the water reservoir chamber, the support frame having a circular periphery which is received within the interior of the cylindrical body, the support frame also having a central opening therein;

a water diversion board having a lower surface and a planar upper surface with a central water dispensing opening and a plurality of holes communicating the planar upper surface with the water reservoir located below, and wherein the water diversion board has a connecting tube which passes through central opening in the support frame;

a water proof pump located in the water reservoir chamber and immersed in water in the chamber in use, the water proof pump being carried on a lower surface of the support frame, and wherein the water proof pump has an outlet port which is in fluid communication with an inlet port of the water diversion board connecting tube, whereby water can be pumped through the connecting tube and out the central water dispensing opening of the water diversion board and over the upper planar surface thereof;

an LED light source located in the water reservoir above the pump, the LED light source being also water proofed, the LED light source having a plurality of light elements which emit light upwardly in the direction of the lower surface of the water diversion board in use;

a lower compartment located in the outer cylindrical body below the water reservoir, the lower compartment being water proof sealed from the water reservoir and containing a battery compartment, an on-off switch and a printed circuit board containing main control electronics for controlling various light effects achievable by the light source.

* * * * *